US008228254B2

(12) United States Patent
Foltz et al.

(10) Patent No.: US 8,228,254 B2
(45) Date of Patent: Jul. 24, 2012

(54) MINIATURIZED ANTENNA ELEMENT AND ARRAY

(76) Inventors: Heinrich Foltz, McAllen, TX (US); Laleh Asgharian, McAllen, TX (US); Seff Shooshtari, McAllen, TX (US)

( * ) Notice: Subject to any disclaimer, the term of this patent is extended or adjusted under 35 U.S.C. 154(b) by 1379 days.

(21) Appl. No.: 09/882,703

(22) Filed: Jun. 14, 2001

(65) Prior Publication Data

US 2005/0140562 A1 Jun. 30, 2005

(51) Int. Cl.
*H01Q 9/16* (2006.01)
*H01Q 19/10* (2006.01)

(52) U.S. Cl. ..... 343/795; 343/818

(58) Field of Classification Search ..... 343/818, 343/795, 702, 830, 700 MS, 803, 813, 793, 343/906, 767, 770, 816, 833, 841, 846, 848, 343/893, 802, 806, 905
See application file for complete search history.

(56) References Cited

U.S. PATENT DOCUMENTS 3,732,572 A * 5/1973 Kuo ..... 343/792.5
4,040,060 A * 8/1977 Kaloi ..... 343/700 MS
4,157,548 A * 6/1979 Kaloi ..... 343/700 MS
4,356,492 A * 10/1982 Kaloi ..... 343/700 MS
4,719,470 A * 1/1988 Munson ..... 343/700 MS
4,754,287 A * 6/1988 Shelton et al. ..... 343/792.5
4,763,131 A * 8/1988 Rosser et al. ..... 343/792.5
4,814,783 A * 3/1989 Shelton et al. ..... 343/795
5,572,222 A * 11/1996 Mailandt et al. ..... 343/700 MS
6,087,989 A * 7/2000 Song et al. ..... 343/700 MS
6,160,515 A * 12/2000 McCoy et al. ..... 343/702
6,175,338 B1 * 1/2001 Quade ..... 343/795
6,307,524 B1 * 10/2001 Britain ..... 343/795
6,320,542 B1 * 11/2001 Yamamoto et al. .... 343/700 MS
6,337,666 B1 * 1/2002 Bishop ..... 343/795
6,369,771 B1 * 4/2002 Chiang et al. ..... 343/795
6,407,717 B2 * 6/2002 Killen et al. ..... 343/815
6,417,806 B1 * 7/2002 Gothard et al. ..... 343/700 MS
6,424,309 B1 * 7/2002 Johnston et al. ..... 343/767

* cited by examiner

*Primary Examiner* — Jacob Y Choi
*Assistant Examiner* — Robert Karacsony
(74) *Attorney, Agent, or Firm* — Anthony Matulewicz

(57) ABSTRACT

The invention consists of reduced size dipole and monopole antennas, printed on one side of a substrate with slotted loading patches at the end(s) of the antenna, and a conducting strip on the reverse side to form a folded dipole or monopole structure. The size of the structure is approximately half that of a conventional printed dipole or monopole, while maintaining or increasing the useful bandwidth. The antennas can be used in conjunction with simplified reflector and director elements to form Yagi-Uda arrays, as well as larger broadside arrays consisting of a number of Yagi-Uda arrays operated in conjunction to form a narrow fan beam. The arrays offer improved appearance due to reduced size, simpler mounting, and greater ease in alignment compared to arrays commonly in use for wireless networking.

28 Claims, 11 Drawing Sheets

MINIATURIZED ANTENNA ELEMENT AND ARRAY

FIELD OF THE INVENTION

Figure 1A:
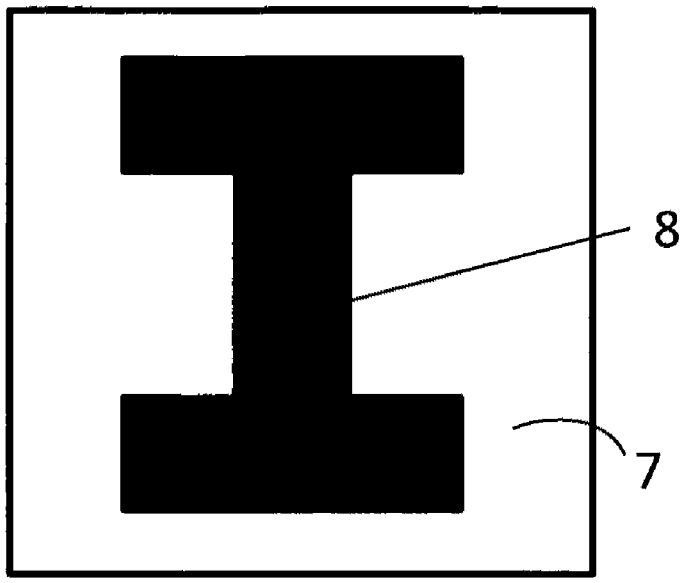

The present invention relates generally to the field of commercial antenna development for wireless internet services.

BACKGROUND OF THE INVENTION

The range and data rate of wireless internet services, as well as other forms of wireless data communications, depend on power, antenna gain, and signal bandwidth, among other factors. All three factors are limited both by economic and size considerations; furthermore, in the most commonly used frequency bands for unlicensed wireless internet services in the US, the 2400-2483.5 MHz ISM (industrial, scientific, and medical) band, as well as in the other unlicensed bands (e.g. 5725-5850 MHz), the transmitter power, transmitting antenna gain, and signal bandwidth are all directly or indirectly limited by federal regulations (Title 47, Part 15, Sec 15.247).

Current regulatory limits for point-to-multipoint communications (e.g. the base to client link when a base serves multiple clients) in the above mentioned bands require spread spectrum operation covering most of the frequency band, and an EIRP (effective isotropic radiated power) of no more than 36 dBm with a transmit power of no more than 30 dBm. Thus systems taking full advantage of the allowable parameter range need an antenna gain of at least 6 dBi. Systems with lower power transmitters need a higher antenna gain, for example, a 20 dBm transmitter is best operated a 16 dBi antenna. Current commonly used solutions for low gain (6-12 dBi) antennas in the ISM band are collinear verticals and corner reflector antennas. Common medium gain antennas (12-20 dBi) are arrays of dipoles and patches, with or without corner reflectors or backplates. For high gain antennas (>20 dBi) parabolic reflectors are almost exclusively used.

The option of reduced transmit power with increased gain is desirable from a point of view of interference reduction, and also reduces the transmitter/power amplifier cost. On the other hand, end users generally find smaller antenna size desirable, both for appearance, mounting, and safety concerns. Furthermore, lower gain antennas are simpler to align and less critical in their mounting accuracy.

The present invention addresses the need for antennas with reasonably high gain (12 to 24 dbi) that have reduced size, both in terms actual volume and in visual size as perceived from a distance, and greater ease in alignment and mounting, while still covering the entire required frequency range. Since electromagnetic principles show that smaller antennas generally have smaller gain and reduced bandwidth, innovative design techniques are needed to achieve a size reduction without impacting performance.

Furthermore, for a particular value of antenna gain, a fan beam with a narrow beamwidth in the horizontal plane and a relatively broad beamwidth in the vertical plane is desirable for three reasons. First, inteference sources/receptors have a tendency to appear distributed along the horizon as seen from the antenna. A narrow beamwidth in the horizontal plane will have significantly improved ability to discriminate between interference sources/receptors and the desired link, while the broad vertical beamwidth will sacrifice little in this respect. Second, having a broad beam in one plane means that accurate pointing is necessary only in the other plane. Thus, a greatly simplified mounting structure with only one degree of freedom is possible, improving both cost and rigidity. Third, since only one degree of freedom is available in the mounting initial alignment when the antenna is installed is simplified.

The present invention employs techniques including antenna folding, dielectric loading and end loading in a printed circuit format in order to reduce the size of the antenna, in particular the height when used as a vertical polarization radiator. The gain is achieved by employing both Yagi-Uda and broadside array techniques. The array configuration also yields a beam that is narrower in the horizontal plane than in the vertical plane. The combination of reduce size, ease of mounting, and interference reduction should be attractive and useful, particularly for client stations in a situation where multiple clients communicate with a base station.

SUMMARY OF THE INVENTION

It is one object of the invention to provide a low profile, reduced size antenna.

It is another object of the invention to provide reduced size dipole and monopole antennas, printed on one side of a substrate with slotted loading patches at the end(s) of the antenna, and a conducting strip on the reverse side to form a folded dipole or monopole structure.

It is another object of the invention to provide linear and/or broadside Yagi-Uda arrays of reduced size elements to form a directional antenna, with narrow beamwidth in one plane and broader beamwidth in another plane.

DETAILED DESCRIPTION OF THE INVENTION

A First Embodiment

Figure 1B:
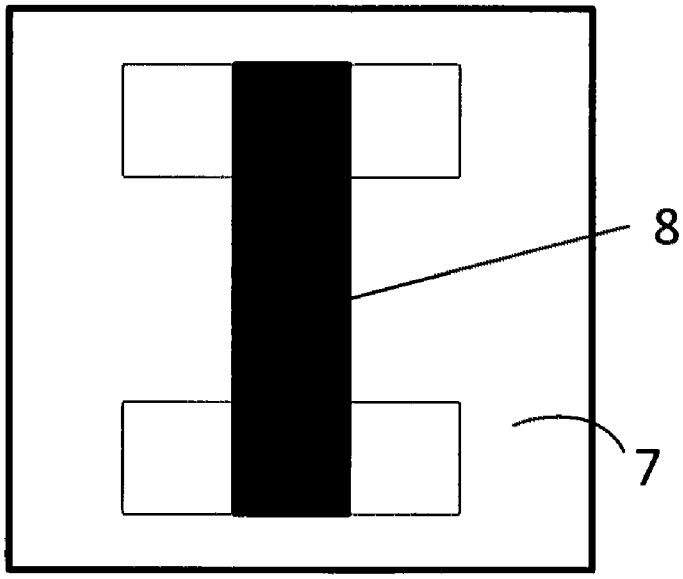
Figure 2A:
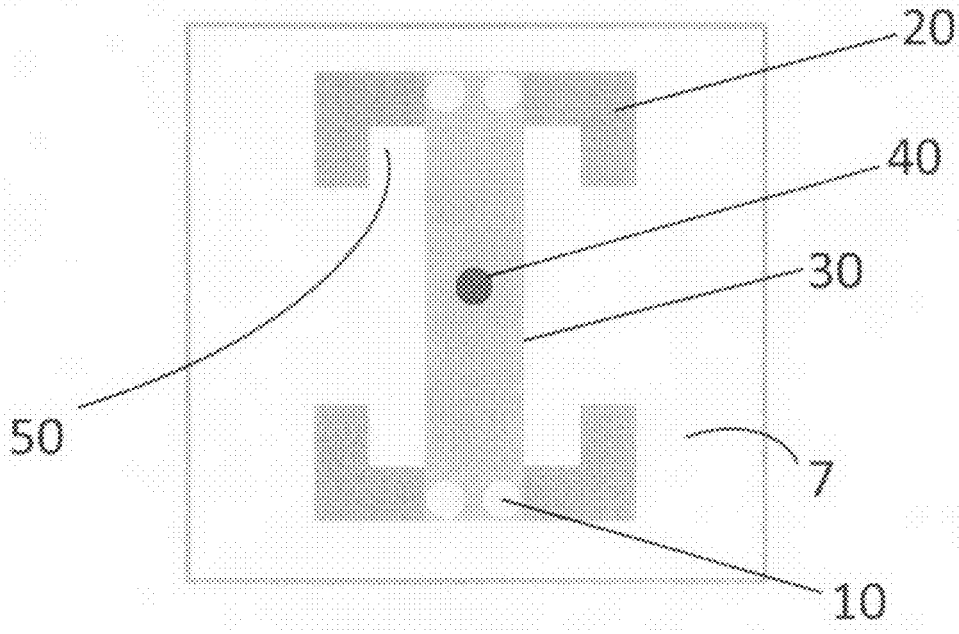
Figure 2B:
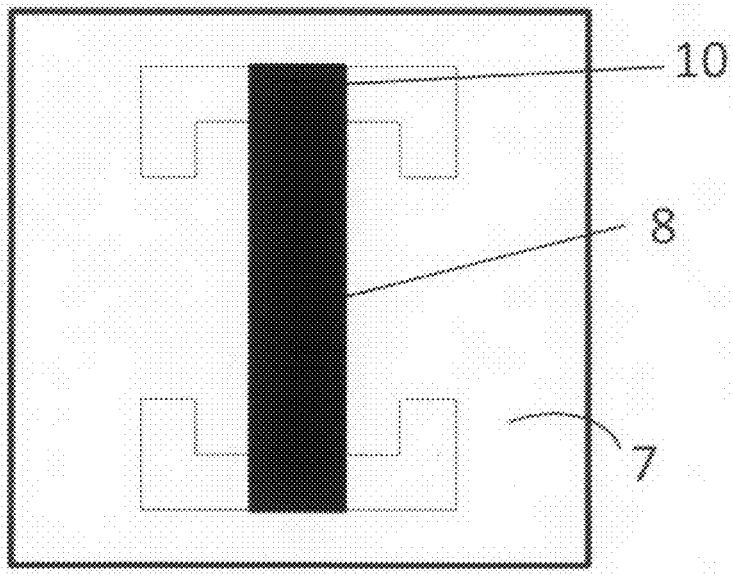

1. The first component to be described is a reduced size printed dipole antenna element, as depicted in FIG. 1*a*, FIG. 1*b*, FIG. 2 and FIG. 2*b*. FIGS. 1*a* and 2*a* depict the front side of the element, and FIGS. 1*b* and 2*b* depict the reverse side. As illustrated in FIGS. 1*a* and 1*b*, the reduced size printed dipole antenna element consists of a dielectric substrate (7), with patterned regions (for example, metalized regions) (8) which can be formed by any of the processes commonly used to form printed circuits. As illustrated in FIGS. 2*a* and 2*b* the patterned regions on the front side form a linear, driven conductor (30) with a feed point (40) at the center, as well as end loading patches (20). Slots (50) are cut into the end loading patches in order to effectively extend the length of the linear driven conductor. Although the patches are shown as being rectangular in shape, similar performance can be obtained with other shapes, for example, round. The loading patches have the effect of lowering the first resonant frequency of the antenna for a given length; or, conversely, reducing the length required to obtain resonance at a given frequency. However, this length reduction, if used alone, tends to reduce the radiation resistance of the antenna, leading to poor impedance match and lower efficiency. It also decreases the bandwith. These effects can be compensated by the placement of a linear, undriven conductor (33) on the reverse side of the substrate, electrically connected to the driven conductor through via holes (10) in the substrate. In the preferred embodiment, the via hole connections are at the ends of the antenna, to form a folded dipole. In other embodiments the position of the holes could be moved to another position along the antenna to modify the impedance. The folding effected as described increases the input impedance, and thus the radiation resistance. If the driven conductor strip and the undriven conductor strip are of equal width the radiation resistance increases by a factor of four; by varying the widths different multiplication factors can be obtained. The driven and undriven conductor strips also form a parallel strip transmission line with dielectric loading due to the substrate. The dielectric has the effect of reducing the velocity of the transmission line. By proper selection of the dielectric constant and length of the antenna, the transmission line can be made antiresonant at the same frequency at which the antenna structure is resonant. The combination of antiresonance and resonance allows the antenna to have a double-tuned response, and a bandwidth which is greatly improved over a simple resonant response.

In a typical design for operation at 2.45 GHz, the length of the antenna is 1.2 inches, the width of the conducting strip is 0.16 inches, the patch measures 0.4 inches by 0.5 inches, and the slots are 0.02 inches wide by 0.16 inches long. The substrate is 0.031 inches thick with a dielectric constant of 4.7. The antenna is typically half the length of a conventional antenna at this frequency. However, modification of these dimensions is clearly possible to suit various applications; in particular, the design can be easily scaled to any operating frequency using formulas available in textbooks and known to skilled practitioners.

A Second Embodiment

Figure 3:
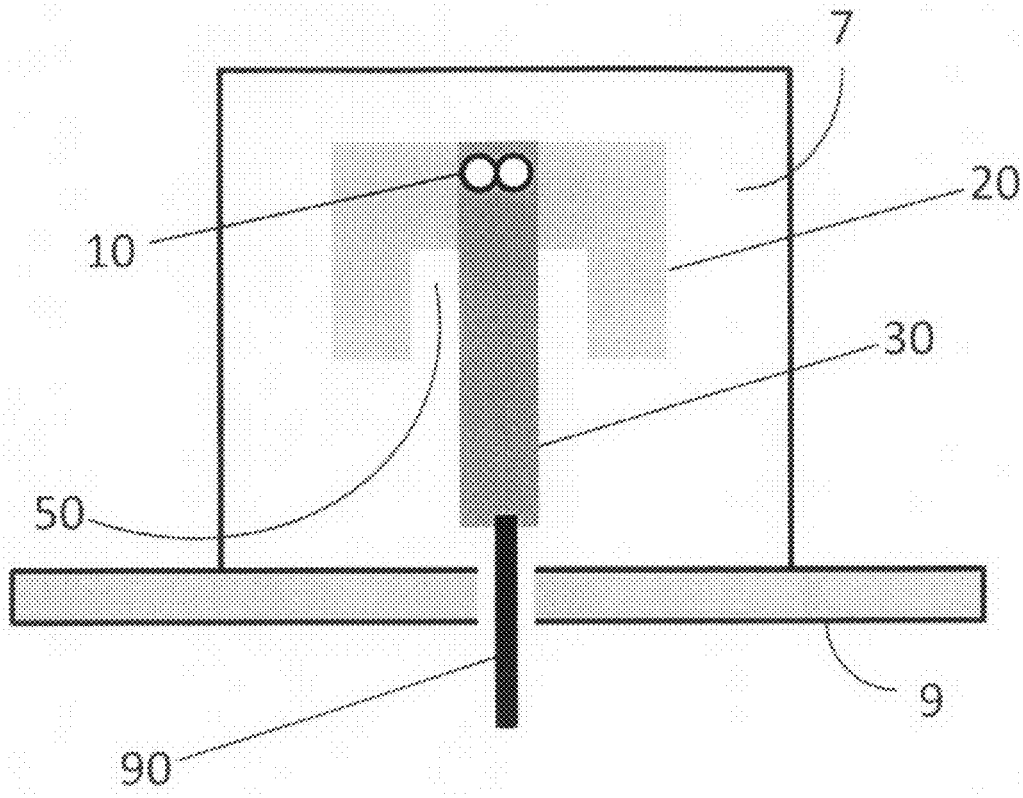

2. The second component to be described is a reduced size printed monopole antenna element based on the same principles, the front side of which is depicted in FIG. 3. It is identical to the reduced size dipole antenna element described above except that only half of the structure is used, and this half is mounted over a conducting ground plane (9), with plane of the antenna substrate (7) perpendicular to the conducting ground plane. The driven element (30) can be excited by a conductor (90) fed through the ground plane. The undriven element on the reverse side is connected directly to the ground plane. Again, by varying the relative widths of the two conducting strips the impedance level can be adjusted, and by proper selection of the antenna length in combination with the dielectric constant of the substrate a broad double-tuned response can be obtained.

A Third Embodiment

Figure 4:
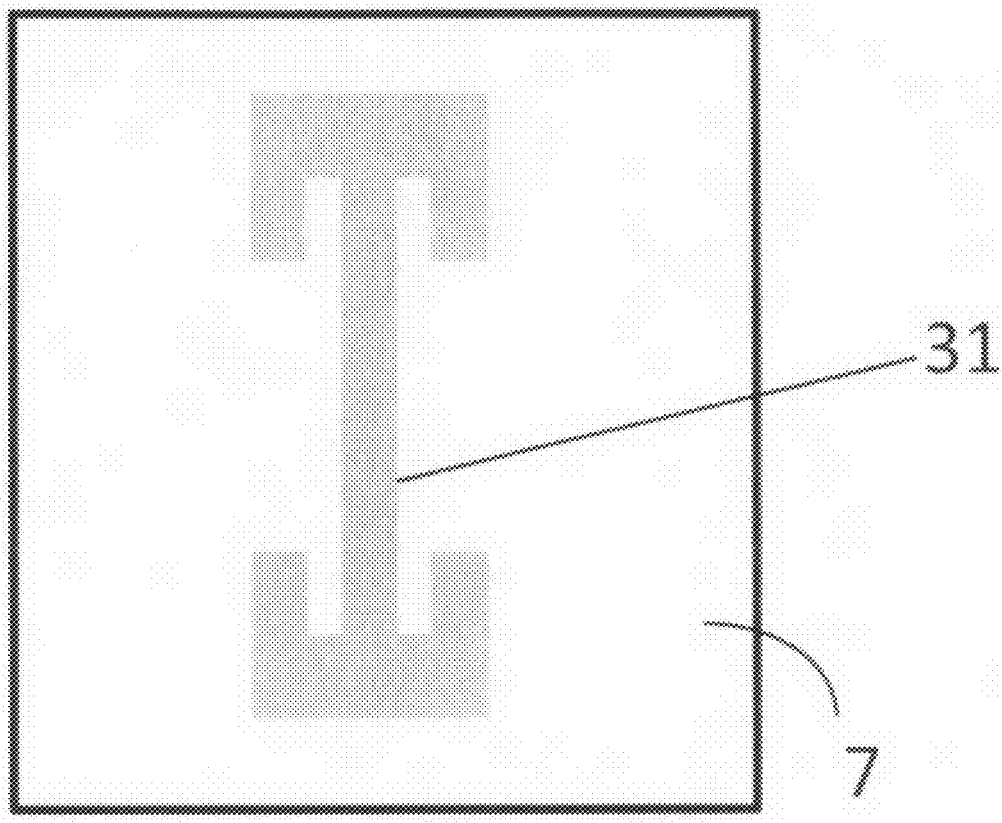

3. The third component to be described is a parasitic (also known as passive) reduced size printed dipole antenna element, the front side of which is depicted in FIG. 4. The element (31) is identical to the front side of the reduced size printed dipole antenna element of the first embodiment described above and shown in FIGS. 1*a*, 1*b*, 2*a*, and 2*b*, except that the undriven conductor, the feed point and the via holes are omitted. The reverse side needs no patterning or metallization and can be left completely bare. A number of these parasitic reduced size printed dipole antenna elements can be used in conjunction with the reduced size printed dipole antenna element described for the first embodiment above and shown in FIGS. 1*a*, 1*b*, 2*a*, and 2*b*, to form Yagi-Uda type arrays, as will be described below. For use as a passsive reflector element, the length is increased (typically by about 10 to 15%) over the length used in the driven element of the dipole antenna described in the first embodiment. For use as a passive director element, the length is decreased (typically by about 10 to 15%) below the length used in the driven element of the dipole antenna described in the first embodiment.

A Fourth Embodiment

4. The fourth component to be described is a parasitic (also known as passive) reduced size printed monopole antenna element. The element is identical to the front side of the reduced size printed monopole antenna element of the second embodiment described above and shown in FIG. 3 except that the undriven conductor, the conductor feed, and the via holes are omitted. The conducting element is connected directly to the ground plane. The reverse side needs no patterning or metallization and can be left completely bare. A number of parasitic reduced size printed monopole antenna elements can be used in conjunction with the reduced size printed monopole antenna element described for the second embodiment above and shown in FIG. 3, to form Yagi-Uda type arrays, as will be described below. For use as a passsive reflector element, the length is increased (typically by about 10 to 15%) over the length used in the driven element of the monopole antenna described in the second embodiment. For use as a passive director element, the length is decreased (typically by about 10 to 15%) below the length used in the driven element of the monopole antenna described in the second embodiment.

A Fifth Embodiment

5. The fifth item to be described is a Yagi-Uda type array formed from combinations of the elements described in the previous paragraphs. In the same manner as conventional dipoles and monopoles, the reduced size printed antenna elements described above can be combined in antenna arrays of any type, using methods that are familiar to skilled practitioners.

Figure 5:
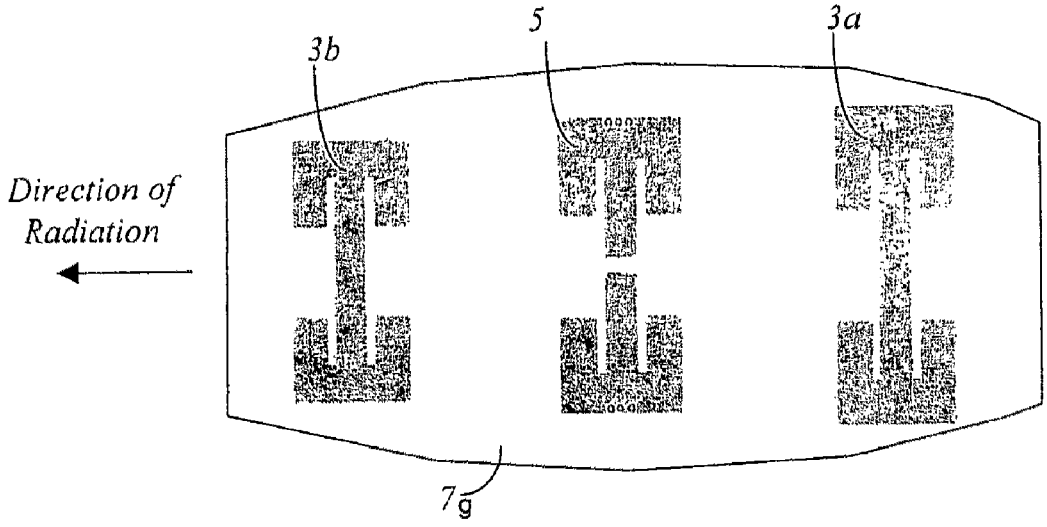

In the embodiment of the invention, depicted in FIG. 5, the elements of the array are coplanar and can be conveniently printed on a single substrate (7*g*). An enlarged version of the parasitic reduced size printed dipole element described for the third embodiment above is used as a reflector element (3*a*), while one or more smaller versions of the same element are used as director elements (3*b*). A reduced size printed dipole element as described in part 1 above is placed between the reflector element and the director elements and is used as the driven element (5). The spacing between the elements is typically about 0.2 wavelengths. The spacing can be varied in conjunction with the lengths of the reflector and director elements in order to adjust the gain, pattern, and frequency response of the antenna. Performance substantially comparable to conventional Yagi-Uda arrays is obtained, with a narrow beam radiated along the array axis in the direction of the director element and reduced radiation in the direction of the reflector element. A front-to-back ratio of 15 dB can be readily obtained.

A Sixth Embodiment

Figure 6:
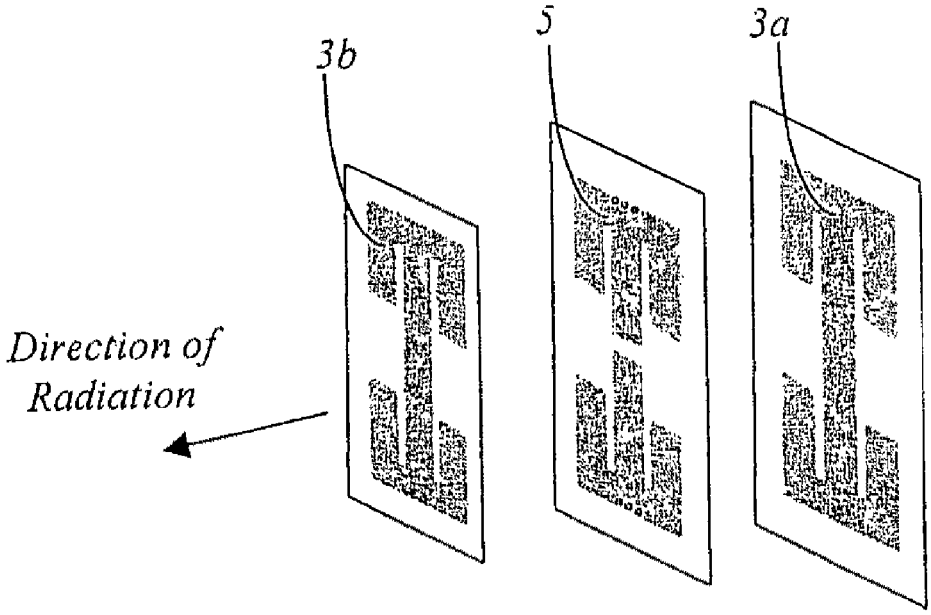

In another embodiment, depicted in FIG. 6, the elements are printed on separate substrates transverse to the array axis. Both configurations can yield a directive pattern with good front-to-back ratio.

It should be noted that both of the embodiments of the Yagi-Uda array can be implemented effectively using the monopole versions of the driven and parasitic elements, as described in the second and fourth embodiments above.

A Seventh Embodiment

Figure 7:
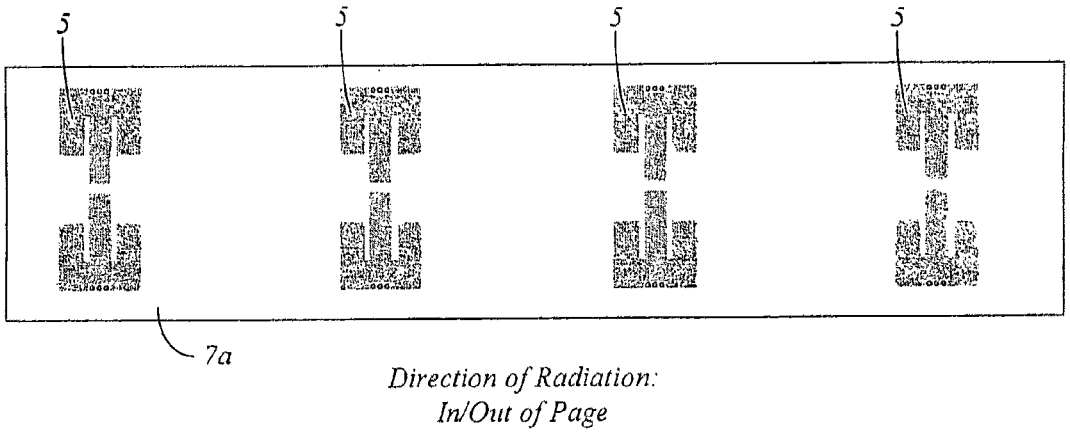

6. The seventh item to be described is a broadside array formed from combinations of the elements described in the first four embodiments. A typical embodiment is shown in FIG. 7, and consists of a number of driven reduced size printed dipole antenna elements (5) as described in the first embodiment, positioned on a single substrate (7*a*). In a preferred embodiment the elements are spaced equally, typically with a spacing of not less than one-quarter and not more than one-half wavelength; however, unequal spacings and spacings outside the typical range may be used.

Figure 8:
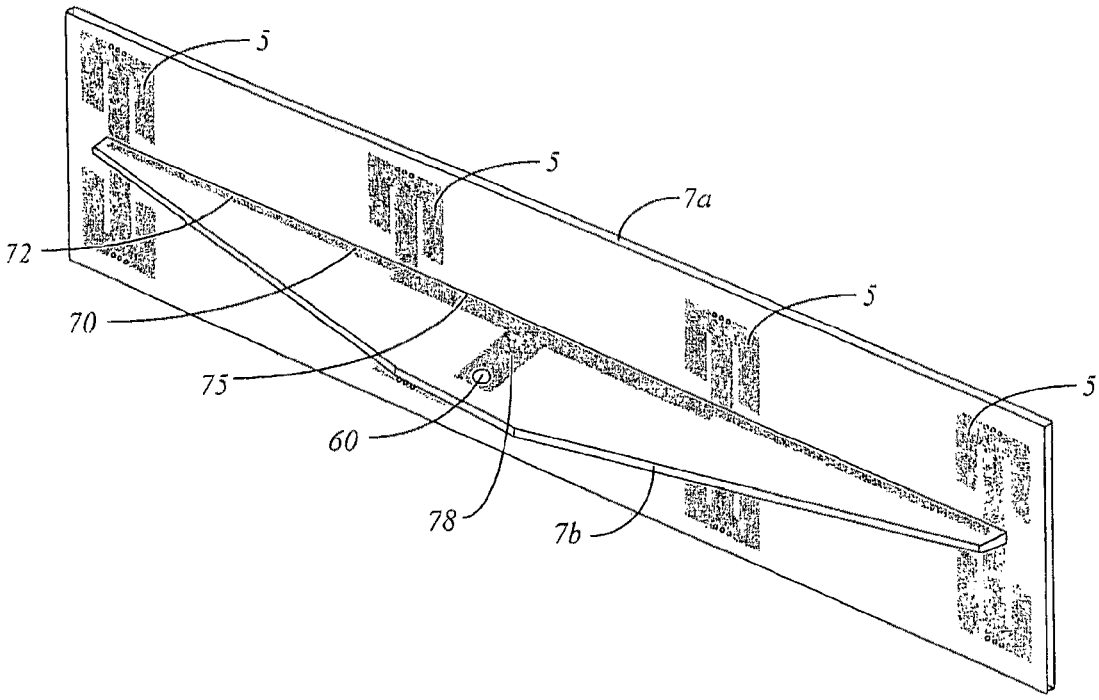
Figure 9:
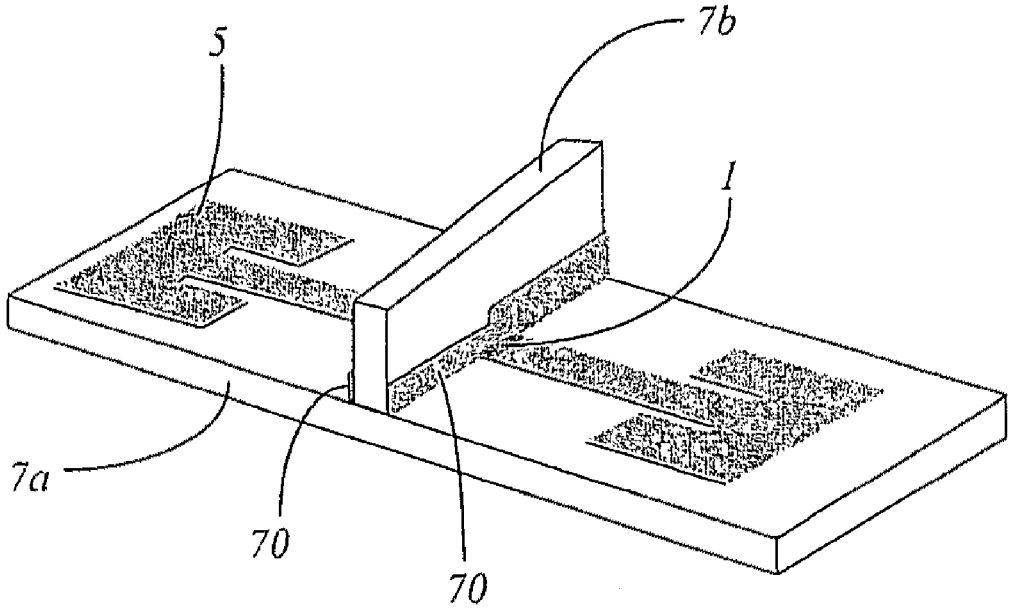

A method for feeding the broadside array is depicted in FIGS. 8 and 9, with FIG. 8 showing an overall view and FIG. 9 a cross section detail. A second substrate (7*b*) is mounted perpendicular to the first substrate (7*a*) A pattern of parallel strip transmission lines (70), is positioned on substrate (7*b*) such that strips of transmission lines on one surface of the substrate (7*b*) are parallel to strips of transmission lines on the other surface of substrate(7*b*). Transmission lines (70) comprise the narrow transmission lines (72) and the wider transmission lines (75). In the preferred embodiment, narrower and thus higher impedance transmission lines (72) are used to feed the outer elements (5) on substrate (7*a*) and wider and thus lower impedance transmission lines (75) are used to feed the inner elements (5) on substrate (7*a*). By proper selection of the widths of the transmission lines the impedances can be arranged such that substantially equal power is distributed to each element in the broadside array. And, by proper selection of the line lengths, taking into account the dielectric constant of the substrate material (7*b*), the drive to each element can be made to be substantially in phase. The combination of equal power and phase gives high gain broadside radiation.

By slight modifications of the widths, a tapered amplitude distribution can also be obtained to reduced sideload levels at the cost of reducing the gain. At the center, a perpendicular feed line (78) is added to step the overall impedance up to a level suitable for feeding from standard coaxial cables, using a connector mounted at a feed point (60).

The transmission lines (72) and (75) are connected to the feed points of the driven elements (5) at the point where the antenna substrate (7*a*) and feed substrate (7*b*) join, typically through solder joints at the junctions, although any electrical connection type may be used.

The broadside array will yield a vertical fan-beam radiation pattern that is much more narrow in the horizontal plane than in the vertical plane. This will ease mounting and alignment difficulties in usage of antennas in applications such as client side radios in wireless networks, since the antenna mount only needs precision adjustment in one plane.

Thus the antenna could be mounted on a simple pole that could be rotated to point it towards a base station. In a typical embodiment with four elements both substrates (7*a*) and (7*b*) have dielectric constants of about 4.0 and the spacing of the elements is approximately 0.5 free space wavelengths, with the narrower lines (72) having a characteristic impedance of about 100 ohms and the wider lines (75) having a characteristic impedance of about 50 ohms, and the center feed line (78) having a characteristic impedance of about 37 ohms, resulting in a beamwidth of approximately 16 degrees.

An Eight and Ninth Embodiment

7. The eight and ninth items to be described are arrays combining broadside and Yagi-Uda techniques. The arrays can take many different forms. Two particular embodiments are described here.

Figure 10:
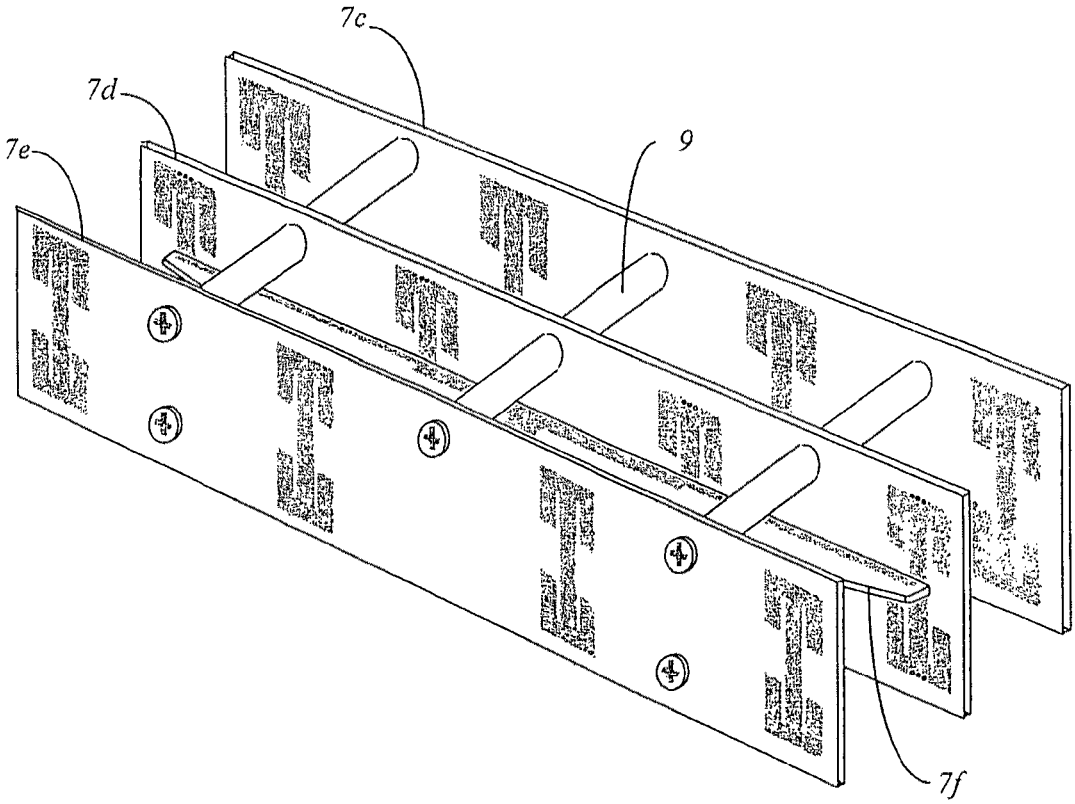

The embodiment shown in FIG. 10, comprises three or more antenna substrates (7*c*, 7*d*, and 7*e*) and one feed substrate (7*f*). Substrates 7*d* and 7*f* and the elements positioned on substrates 7*d* and 7*f* are assembled in a way similar to that described in the seventh embodiment and illustrated in FIGS. 8 and 9 for the substrates 7*a* and 7*b* and the element positioned on substrates 7*a* and 7*b*. Substrate 7*c* has positioned on it a number of enlarged versions of the parasitic elements described in the third embodiment, with spacings equal to that on substrate 7*d*, with each element on 7*c* serving as a reflector for the corresponding element on 7*d*. Substrate 7*e* has positioned on it a number of smaller versions of the parasitic elements described in the third embodiment, with spacings equal to that on substrate 7*d*, with each element on 7*e* serving as a director for the corresponding element on 7*d*. Additional substrates with director elements of the type used in 7*e* can be added to extend the Yagi-Uda array effect.

Figure 11:
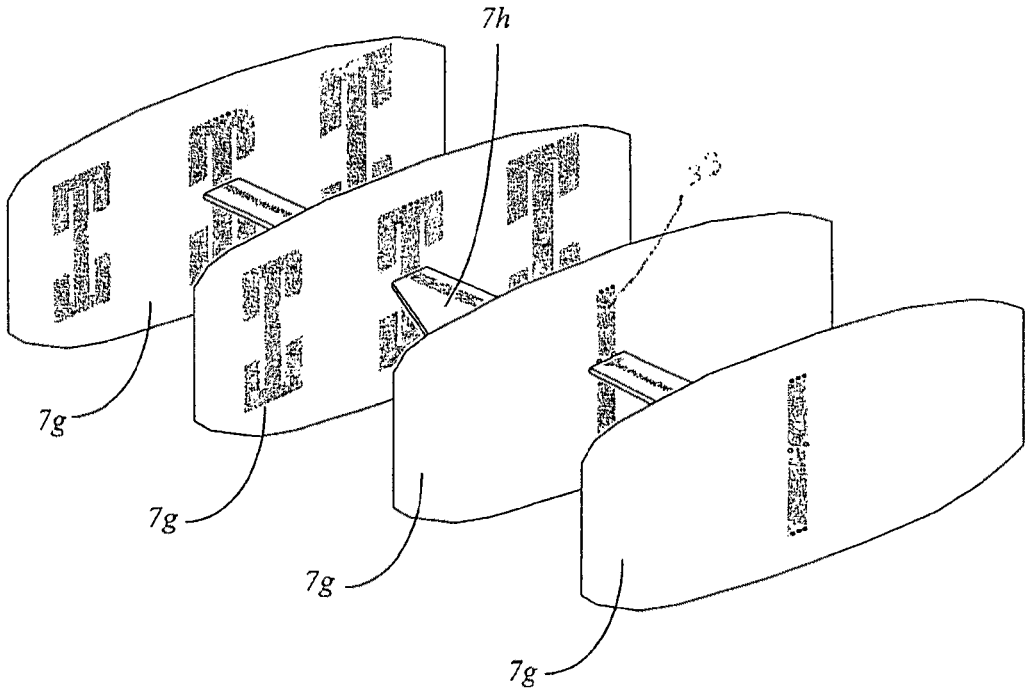

The embodiment shown in FIG. 11, comprises a number of single substrates (7*g*), each containing a Yagi-Uda array of the type described on the fifth embodiment and shown in FIG. 5. The individual arrays are placed such that the substrate planes are parallel but displaced, and distributed along an axis perpendicular to both the individual arrays and the reduced size printed dipole antenna elements themselves. A feed substrate (7*h*), substantially identical to the feed substrate 7*b* described in the seventh embodiment and shown as in FIG. 8, is used to feed the driven elements of the individual arrays with approximately equal amplitude and phase, although the amplitudes could be tapered by modification of the feedline widths.

In both cases, the result is to obtain increased gain by combining the Yagi-Uda effect with the broadside array effect. Again, a narrow vertical fan beam can be obtained due to the broadside array, while the Yagi-Uda arrangement increases the forward gain and yields a high front-to-back ratio.

8. While the present invention has been described with reference to a few specific embodiments, the description is illustrative and is not to be construed as limiting the invention. Various modifications may occur to those skilled in the art without departing from the true spirit and scope of the invention as defined by the appended claims.

What is claimed is:

1. A reduced size printed dipole antenna element comprising;

(a) a dielectric substrate, (b) two conducting patches, one at each end of the dipole antenna element, on one side of said dielectric substrate, (c) a conducting strip, narrower than the patches, connecting the two said conducting patches, with a feed point at the center, forming a radiating part of the dipole antenna element, (d) slots cut into said conducting patches to effectively extend the length of said conducting strip, and (e) a second conducting strip on the reverse side of said dielectric substrate, forming a parallel strip transmission line with said conducting strip and electrically connected to said conducting patches through the use of via holes in said dielectric substrate.

2. A reduced size printed monopole antenna, comprised of one half of the dipole antenna element in claim 1, mounted on a ground plane, with said conducting strip driven and said second conducting strip connected to said ground plane.

3. A reduced size printed dipole antenna comprising:

(a) a dielectric substrate, said dielectric substrate having a front side and a reverse side;

(b) a patterned region on each side of said dielectric substrate; and (c) via holes;

wherein, the patterned region on the front side of said substrate forms a linear, driven conductor and at least one loading patch; said driven conductor has a feed point and two ends; said driven conductor being excitable at said feed point; each said loading point being connected to an end of said driven conductor; and, each said loading patch being shaped to effectively extend the length of said driven conductor; and wherein, the patterned region on the reverse side of said substrate forms a linear, undriven conductor; and wherein, said undriven conductor is parallel to said driven conductor, and said undriven conductor is electrically connected to said driven conductor through said via holes.

4. The reduced size printed dipole antenna of claim 3 wherein the feed point is at the center of said driven conductor.

5. The reduced size printed dipole antenna of claim 3 wherein said via holes are positioned at one end of said driven conductor such that said driven and undriven conductors form a folded dipole.

6. The reduced size printed dipole antenna of claim 3 wherein said driven and undriven conductors form a parallel strip transmission line.

7. The reduced size printed dipole antenna of claim 6 wherein the dielectric constant of said dielectric substrate, the lengths of said driven and undriven conductors, and the size and shape of said patches are selected such that said transmission line is anti-resonant at the same frequency at which the antenna is resonant.

8. The reduced size printed dipole antenna of claim 3 further comprising a parasitic dipole element director element on the front side of said substrate and a parasitic dipole reflector element on the front side of said substrate, wherein said dipole element is positioned between said parasitic director element and said reflector element such that a Yagi-Uda type directional array is formed.

9. The reduced size printed dipole antenna of claim 3 further comprising a parasitic dipole director element on the front side of a second dielectric substrate and a parasitic dipole reflector element on the front side of a third dielectric substrate, wherein said dipole antenna is positioned between said parasitic director element and said reflector element such that a Yagi-Uda type directional array is formed.

10. A reduced size printed monopole antenna comprising:

(a) a dielectric substrate, said dielectric substrate having a front side and a reverse side;

(b) a patterned region on each side of said dielectric substrate;

(c) a ground plane; and (d) via holes;

wherein said dielectric substrate is mounted over said ground plane; and wherein, the patterned region on the front side of said substrate forms a linear, driven conductor and at least one loading patch; wherein said linear, driven conductor has a first end and a second end and each loading patch is connected to the first end of said linear, driven conductor, and each said loading patch is shaped to effectively extend the length of said driven conductor; and wherein said linear, driven conductor is excitable by an external conductor; and wherein the patterned dielectric region on the reverse side of said substrate forms a linear, undriven conductor; wherein said linear, undriven conductor has a first end and a second end; wherein said undriven conductor is parallel to said driven conductor; and wherein the first end of said linear, driven conductor is electrically connected to the first end of said undriven conductor through said via holes; and wherein the second end of said undriven conductor is directly connected to said ground plane.

11. The reduced size printed monopole antenna of claim 10 wherein the dielectric constant of said dielectric substrate, the lengths of said driven and undriven conductors, and the size and shape of said patches are selected such that a double-tuned response is obtainable.

12. The reduced size printed monopole antenna of claim 10 wherein said ground plane is a conducting ground plane.

13. The reduced size printed monopole antenna of claim 10 wherein said external conductor is fed through said ground plane and electrically attached to said driven conductor.

14. The reduced size printed monopole antenna of claim 10 wherein said external conductor is mounted on said ground plane and electrically attached to said driven conductor.

15. The reduced size printed monopole antenna of claim 10 wherein said external conductor is printed on said ground plane and electrically attached to said driven conductor.

16. The reduced size printed monopole antenna of claim, 10 wherein said dielectric substrate is perpendicularly mounted on said ground plane.

17. A dipole antenna array comprising at least one reduced size printed dipole antenna, wherein each said reduced size printed dipole comprises:

(a) a dielectric substrate, said dielectric substrate having a front side and a reverse side;

(b) a patterned region on each side of said dielectric substrate; and (c) via holes;

wherein, the patterned region on the front side of said substrate forms a linear, driven conductor and at least one loading patch; said driven conductor has a feed point and two ends; said driven conductor has a feed point and two ends; said driven conductor being excitable at said feed point; each said loading patch being connected to an end of said driven conductor, and each said loading patch being shaped to effectively extend the length of said driven conductor; and wherein, the patterned region on the reverse side of said substrate forms a linear, undriven conductor; and wherein, said undriven conductor is parallel to said driven conductor, and said undriven conductor is electrically connected to said driven conductor through said via holes.

18. The dipole antenna array of claim 17 wherein every reduced size printed dipole antenna is on the same substrate.

19. The dipole antenna array of claim 17 further comprising a plane mounted perpendicularly to said substrate, said plane comprising transmission strips on a least one surface of said plane, wherein said reduced size printed dipole antennas and said plane are aligned such that the transmission lines on said plane are electrically connected to the feed points of each reduced size printed dipole antenna.

20. The dipole antenna array of claim 19 wherein the width of the transmission lines at each feed point is selected to distribute substantially equal power to each antenna.

21. The dipole antenna array of claim 17 wherein each reduced size printed dipole antenna is on a separated substrate.

22. The dipole antenna array of claim 21 further comprising planes mounted perpendicularly to said substrates, said perpendicularly mounted planes comprising transmission strips on at least one surface of each plane, wherein said reduced size printed dipole antennas and said planes are aligned such that the transmission lines on said planes are electrically connected to the feed points of each reduced size printed dipole antenna.

23. The dipole antenna array of claim 22 wherein the width of the transmission lines at each feed point is selected to distribute substantially equal power to each antenna.

24. A monopole antenna array comprising at least one reduced size printed monopole antenna, wherein each said reduced size printed monopole antenna comprises:

(a) a dielectric substrate, said dielectric substrate having a front side and a reverse side;

(b) a patterned region on each side of said dielectric substrate;

(c) a ground plane; and (d) via holes;

wherein said dielectric substrate is mounted over said ground plane; and wherein, the patterned region on the front side of said substrate forms a linear, driven conductor and at least one loading patch; wherein said linear, driven conductor has a first end and a second end and each loading patch is connected to the first end of said linear, driven conductor, and each said loading patch is shaped to effectively extend the length of said driven conductor; and wherein said linear, driven conductor is excitable by an external conductor; and wherein the patterned dielectric region on the reverse side of said substrate forms a linear, undriven conductor; wherein said linear, undriven conductor has a first end and a second end; wherein said undriven conductor is parallel to said driven conductor; and wherein the first end of said linear, driven conductor is electrically connected to the first end of said undriven conductor through said via holes; and wherein the second end of said undriven conductor is directly connected to said ground plane.

25. The monopole antenna array of claim 24 wherein every reduced size printed monopole is on the same substrate.

26. The monopole antenna array of claim 24 wherein every reduced size printed monopole is on a separated substrate.

27. A reduced size printed dipole antenna comprising:

(a) a dielectric substrate, said dielectric substrate having a front side and a reverse side;

(b) a pattern region on each side of said dielectric substrate; and (c) via holes;

wherein, the patterned region on the front side of said substrate forms a linear, driven conductor and at least one loading patch; said driven conductor has a feed point and two ends; said driven conductor being excitable at said feed point; said driven conductor is more narrow than each loading patch; each said loading patch being connected to an end of said driven conductor, and each said loading patch being shaped to effectively extend the length of said driven conductor; and wherein, the patterned region on the reverse side of said substrate forms a linear, undriven conductor; and wherein, said undriven conductor is parallel to said driven conductor, and said undriven conductor is electrically connected to said driven conductor through said via holes.

28. A reduced size printed dipole antenna comprising:

(a) a dielectric substrate, said dielectric substrate having a front side and a reverse side;

(b) a pattern region on each side of said dielectric substrate; and (c) via holes;

wherein the patterned region on the front side of said substrate forms a linear, driven conductor and at least one loading patch; said driven conductor has a feed point and two ends; said driven conductor being excitable at said feed point; each said loading patch being connected to an end of said driven conductor, and each said loading patch being shaped to effectively extend the length of said driven conductor; and wherein, the patterned region on the reverse side of said substrate forms a linear, undriven conductor; and wherein, said undriven conductor is parallel to said driven conductor, and said undriven conductor is electrically connected to said driven conductor through said via holes, and wherein, the positions of via holes at the ends of said driven and undriven conductors are selected such that an electrical connection from said driven conductor to said undriven conductor through said via holes forms a folded dipole.

* * * * *

UNITED STATES PATENT AND TRADEMARK OFFICE

CERTIFICATE OF CORRECTION

PATENT NO. : 8,228,254 B2
APPLICATION NO. : 09/882703
DATED : July 24, 2012
INVENTOR(S) : Heinrich Foltz, Laleh Asgharian and Jeff Shooshtari It is certified that error appears in the above-identified patent and that said Letters Patent is hereby corrected as shown below:

On the Title page, item (76): delete "Seff Shooshtari", and insert --Jeff Shooshtari--.

Signed and Sealed this
Third Day of September, 2013

Teresa Stanek Rea
*Acting Director of the United States Patent and Trademark Office*